US009375071B1

(12) United States Patent
Wang

(10) Patent No.: US 9,375,071 B1
(45) Date of Patent: Jun. 28, 2016

(54) CLAMSHELL CASE WITH STACKABLE INTERMEDIATE LAYER

(71) Applicant: COLOR MARK CO., LTD., Taichung (TW)

(72) Inventor: Hsi-Kun Wang, Taichung (TW)

(73) Assignee: Color Mark Co., Ltd., Taichung (TW)

( * ) Notice: Subject to any disclaimer, the term of this patent is extended or adjusted under 35 U.S.C. 154(b) by 0 days.

(21) Appl. No.: 14/807,945

(22) Filed: Jul. 24, 2015

(51) Int. Cl.
*A45D 40/22* (2006.01)
*B65D 25/02* (2006.01)

(52) U.S. Cl.
CPC ..... *A45D 40/221* (2013.01); *B65D 25/02* (2013.01)

(58) Field of Classification Search
CPC ... A45D 33/00; A45D 33/003; A45D 33/006; A45D 33/008; A45D 33/18; A45D 33/20; A45D 33/22; A45D 33/24; A45D 33/34; A45D 40/0068; A45D 40/18; A45D 40/22; A45D 40/221–40/222; A45D 40/24; A45D 2040/0012; A45D 2200/051; A45C 3/00; A45C 11/00; A45C 11/16; A45C 11/18; A45C 11/24; A45C 13/005; A45C 13/008; A45C 13/02; A45C 13/1084; A45C 15/00; A45C 2011/007; A45C 2011/188; E05F 1/1284; B65D 43/165; B65D 83/0463
USPC ..... 132/286, 293–297, 300–301, 304–305, 132/314–316; 206/6.1, 45.24, 216, 232, 206/235, 307, 308.1, 308.3, 309, 311–312, 206/315.11, 372, 449, 472, 473, 495, 528, 206/534, 536, 538, 566, 581, 748, 823; 220/4.22, 4.27, 23.4, 23.83, 212, 220/259.2, 263, 315, 326, 512, 520, 522, 220/531, 729, 826–827, 835–836, 840, 844, 220/DIG. 26; 16/225, 257, 266–267, 16/329–330, DIG. 13; D3/203.3, 905; D28/77, 82
See application file for complete search history.

(56) References Cited

U.S. PATENT DOCUMENTS 1,688,042 A * 10/1928 Gaess ..... A45D 33/006 132/295
3,342,190 A * 9/1967 Hultgren ..... A45D 40/22 132/301
4,589,431 A * 5/1986 Yuhara ..... A45D 40/22 132/301
4,696,317 A * 9/1987 Shioi ..... A45D 40/22 132/314
4,821,751 A * 4/1989 Chen ..... A45D 33/24 132/295
4,848,585 A * 7/1989 Snyder ..... A45C 11/16 206/315.11
4,964,526 A * 10/1990 Stephens ..... A45C 11/24 132/315
5,351,818 A * 10/1994 Daneshvar ..... A61J 1/03 206/216
5,392,906 A * 2/1995 Taniyama ..... G11B 33/0483 206/308.1

(Continued)

*Primary Examiner* — J. Gregory Pickett
*Assistant Examiner* — Brijesh V. Patel
(74) *Attorney, Agent, or Firm* — Alan D. Kamrath; Kamrath IP Lawfirm, P.A.

(57) ABSTRACT

A clamshell case includes a case bottom, at least one modular intermediate layer, and a lid. The intermediate layer has a coupling slot in an upper back thereof and a pivot block at a lower back thereof. The pivot block is held in a pivot slot of the case bottom, and the intermediate layer is pivotally fitted over the case bottom through at least one pivot or a pivot portion. The lid has a pivot block held in the coupling slot of the intermediate layer and is pivotally fitted over the intermediate layer through at least one pivot or a pivot portion. The costs to manufacture the clamshell case, which is assembled with a specific number of modular intermediate layers stacked on one another as required, can be reduced, because pivot blocks in all modular intermediate layers are of equal height and identical axial position.

7 Claims, 12 Drawing Sheets

(56) References Cited

U.S. PATENT DOCUMENTS

| | | | | | |
|---|---|---|---|---|---|
| 5,638,838 | A * | 6/1997 | Lombardi | A45C 13/005 | 132/294 |
| 5,704,378 | A * | 1/1998 | Machelett | A45C 13/005 | 132/293 |
| 6,070,749 | A * | 6/2000 | Joulia | A45D 40/222 | 132/294 |
| 6,099,097 | A * | 8/2000 | Hocker | G06F 1/181 | 16/225 |
| 6,240,930 | B1 * | 6/2001 | Yuhara | A45C 13/008 | 132/293 |
| 7,351,215 | B1 * | 4/2008 | Roberts | A45D 33/24 | 132/294 |
| 7,441,309 | B2 * | 10/2008 | Suzuki | A45C 13/005 | 132/286 |
| D622,003 | S * | 8/2010 | Naughton | D28/82 | |
| D631,608 | S * | 1/2011 | Pires | D28/82 | |
| 7,942,267 | B2 * | 5/2011 | Coe | A45C 11/00 | 206/473 |
| 2005/0056559 | A1 * | 3/2005 | Chen | B25H 3/003 | 206/372 |
| 2006/0180481 | A1 * | 8/2006 | McGaughey | A47F 7/02 | 206/6.1 |
| 2007/0131680 | A1 * | 6/2007 | Banik | A45D 40/221 | 220/4.22 |
| 2008/0173324 | A1 * | 7/2008 | Washington | A45D 33/008 | 132/295 |
| 2012/0055503 | A1 * | 3/2012 | Kuo | A45D 40/221 | 132/293 |
| 2014/0014131 | A1 * | 1/2014 | Zhang | A45D 33/008 | 132/316 |

* cited by examiner

CLAMSHELL CASE WITH STACKABLE INTERMEDIATE LAYER

BACKGROUND OF THE INVENTION

The present invention relates to a clamshell case and, more particularly, to a clamshell case with multiple layers conveniently adjustable as required.

In general, a clamshell case (for example, a makeup case) includes a liftable lid and a case bottom internally divided into several compartments in which cosmetics such as colorful pressed powder and eye shadow are held. A single-decker clamshell case, consisting of a lid and a case bottom, however, is difficult to meet a user's practical demands, because limited cosmetics are held inside.

Currently, some manufacturers have developed multi-decker clamshell cases in which various cosmetics, including eye shadow, rouge, blusher and nail polish, are held for improvement of single-decker clamshell cases. Generally, a conventional multi-decker clamshell case includes a case bottom, a lid and a plurality of intermediate layers (intermediate case bodies) between the case bottom and the lid. Each of the lid and the intermediate layers has a pivot block at the back, and the case bottom is provided with two spaced pivot portions situated at the back. Each of the pivot blocks and the pivot portions has a pinhole. All of the lid, the intermediate layers and the case bottom will be pivotally fitted to one another with the pivot blocks of both the lid and the intermediate layers arranged between the pivot portions of the case bottom and with a pivot extending through the pinholes of the lid, the intermediate layers and the case bottom. In the conventional multi-decker clamshell case, the pivot blocks of the lid and the intermediate layers, each of which keeps a distinct distance from the case bottom, are different in height. Therefore, the manufacturing costs to produce molds for various intermediate layers with different-height pivot blocks in the conventional multi-decker clamshell case are high. Moreover, the number of intermediate layers in the multi-decker clamshell case is limited because of restricted heights of the pivot blocks of the intermediate layers. Further, the number of intermediate layers in the multi-decker clamshell case cannot be freely adjusted by a user as required.

BRIEF SUMMARY OF THE INVENTION

It is an objective of the present invention to provide a clamshell case for improving the above mentioned problems. The clamshell case of the present invention is economically manufactured, because the clamshell case can be assembled by a user with a specific number of modular intermediate layers stacked on one another as required.

To achieve this and other objectives, a clamshell case of the present invention includes a case bottom, at least one intermediate layer, and a lid. The case bottom includes a bottom plate and a wall plate extending upward from an edge of the bottom plate. A pivot slot is formed in an upper back of the wall plate, and two opposite pivot holes are provided in the wall plate and located at two sides of the pivot slot. The intermediate layer is pivotally fitted over the case bottom and includes a seat board and an enclosure extending upward from an edge of the seat board. A coupling slot is formed in an upper back of the enclosure, and two opposite pivot holes are provided in the enclosure and located at two sides of the coupling slot. A pivot block protrudes from a lower back of the enclosure and includes a transverse pinhole therein. The pivot block of the intermediate layer is held in the pivot slot of the case bottom with two pivots respectively penetrating the pivot holes of the case bottom into the pinhole of the intermediate layer. The lid is pivotally fitted over the intermediate layer and includes a cover plate and a wall plate extending downward from an edge of the cover plate. A pivot block protrudes from a lower back of the wall plate of the lid and includes a transverse pinhole therein. The pivot block of the lid is held in the coupling slot of the intermediate layer with two pivots respectively penetrating the pivot holes of the intermediate layer into the pinhole of the lid.

In a preferred form, the at least one intermediate layer includes a plurality of intermediate layers. The pivot block of one of the plurality of intermediate layers is held in the coupling slot of another one of the plurality of intermediate layers. The one of the plurality of intermediate layers is stacked on and pivotally fitted at the other one of the plurality of intermediate layers with two pivots penetrating the pivot holes of the other one of the plurality of intermediate layers into the pinhole of the one of the plurality of intermediate layers.

The present invention will become clearer in light of the following detailed description of illustrative embodiments of this invention described in connection with the drawings.

DETAILED DESCRIPTION OF THE INVENTION

Figure 1:
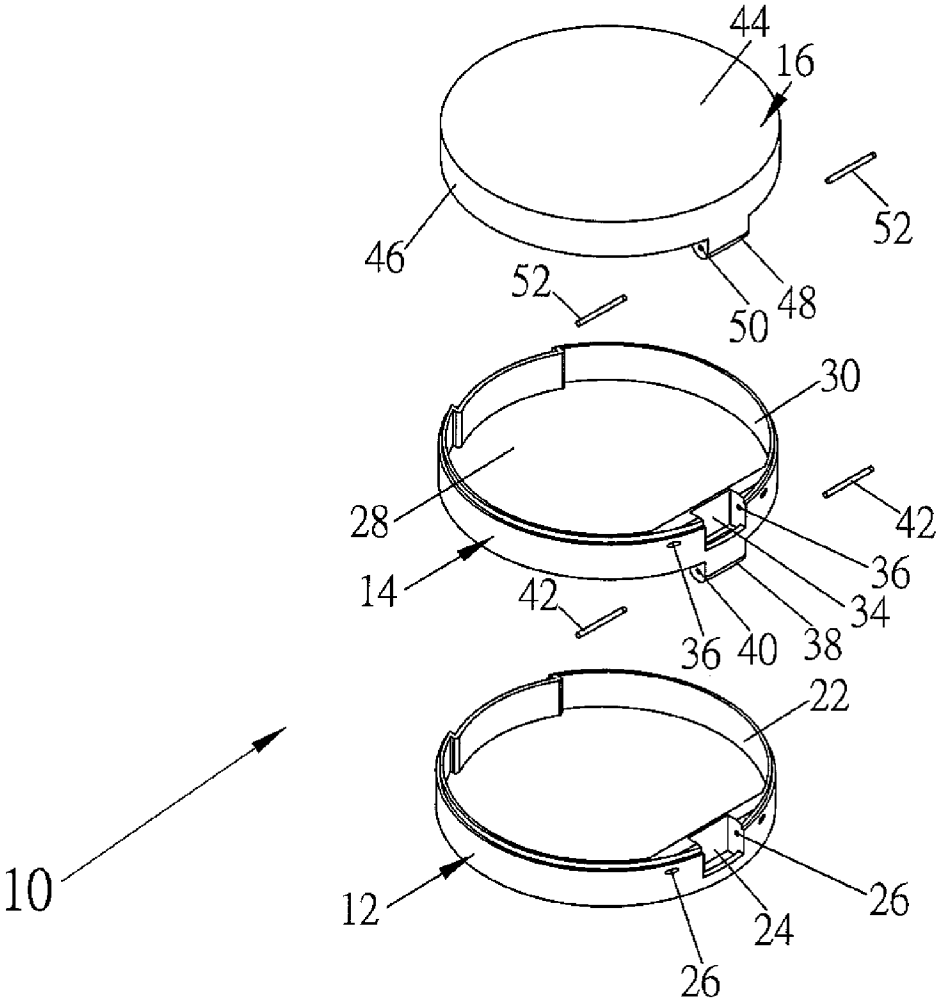
FIG. 1 is an exploded, perspective view of a clamshell case according to a first embodiment of the present invention.
Figure 2:
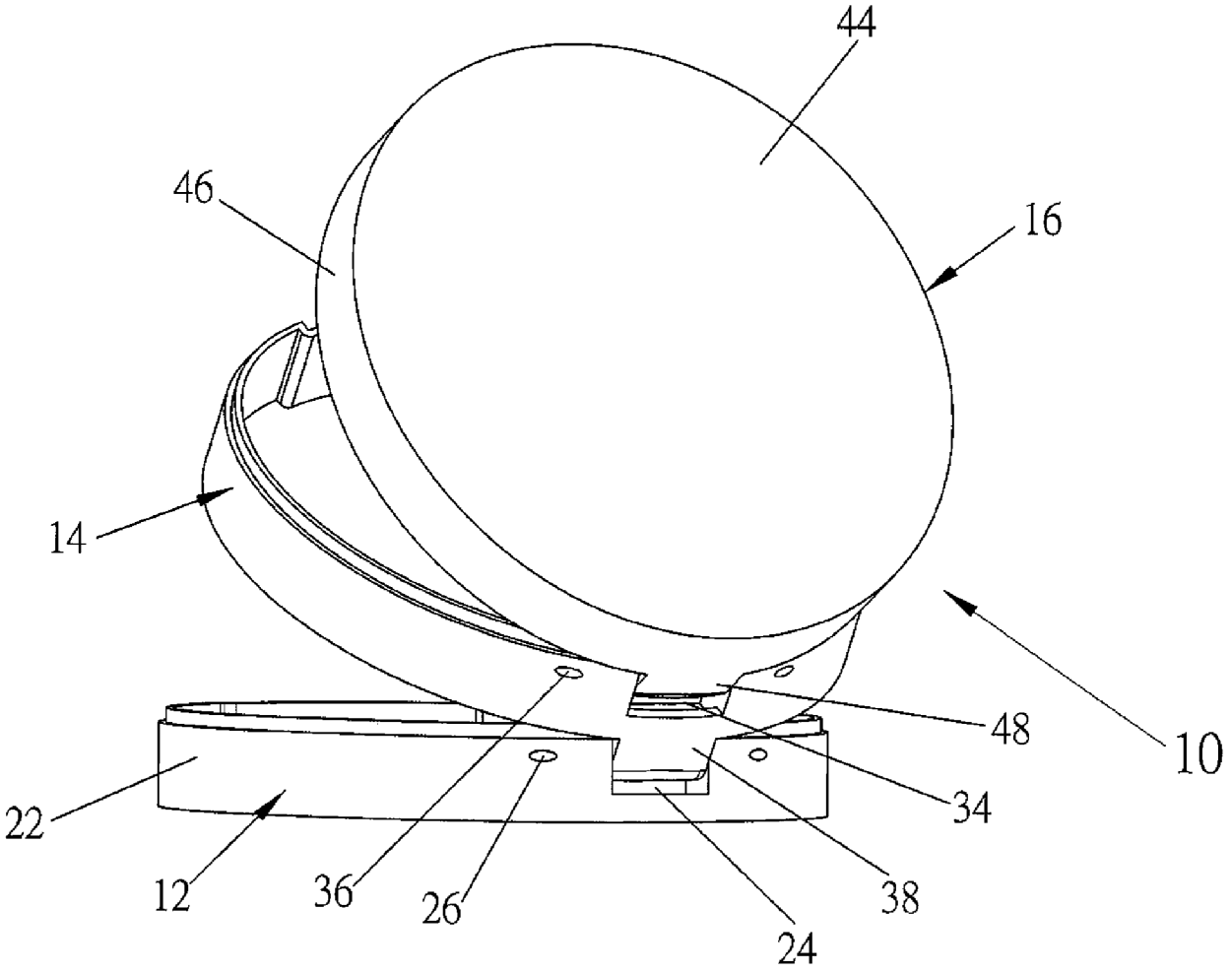
FIG. 2 is a perspective view of the clamshell case of FIG. 1, illustrating both a lid and an intermediate layer of the clamshell case opened.
Figure 3:
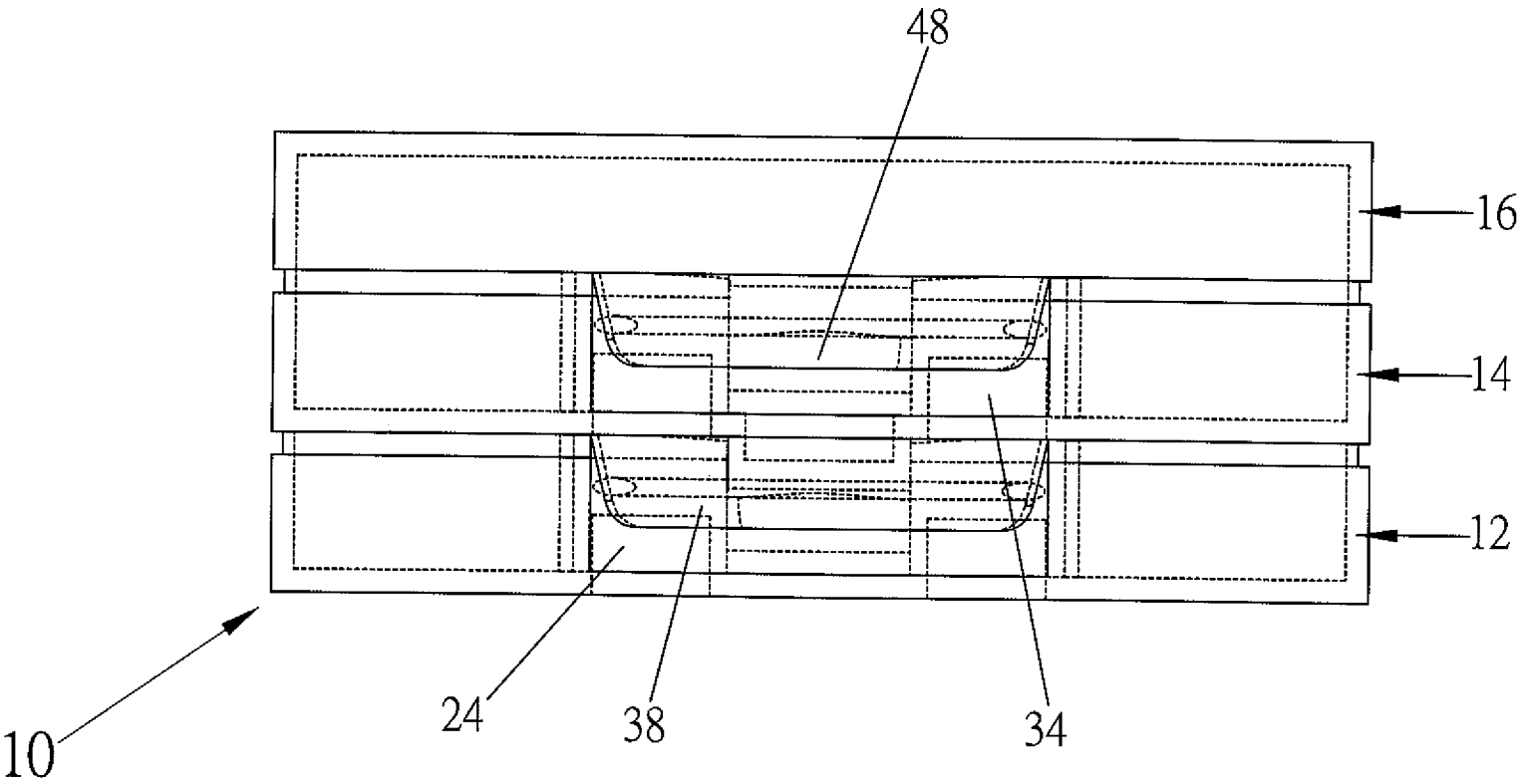
FIG. 3 is a schematic view of the clamshell case of FIG. 1 which is assembled.
Figure 4:
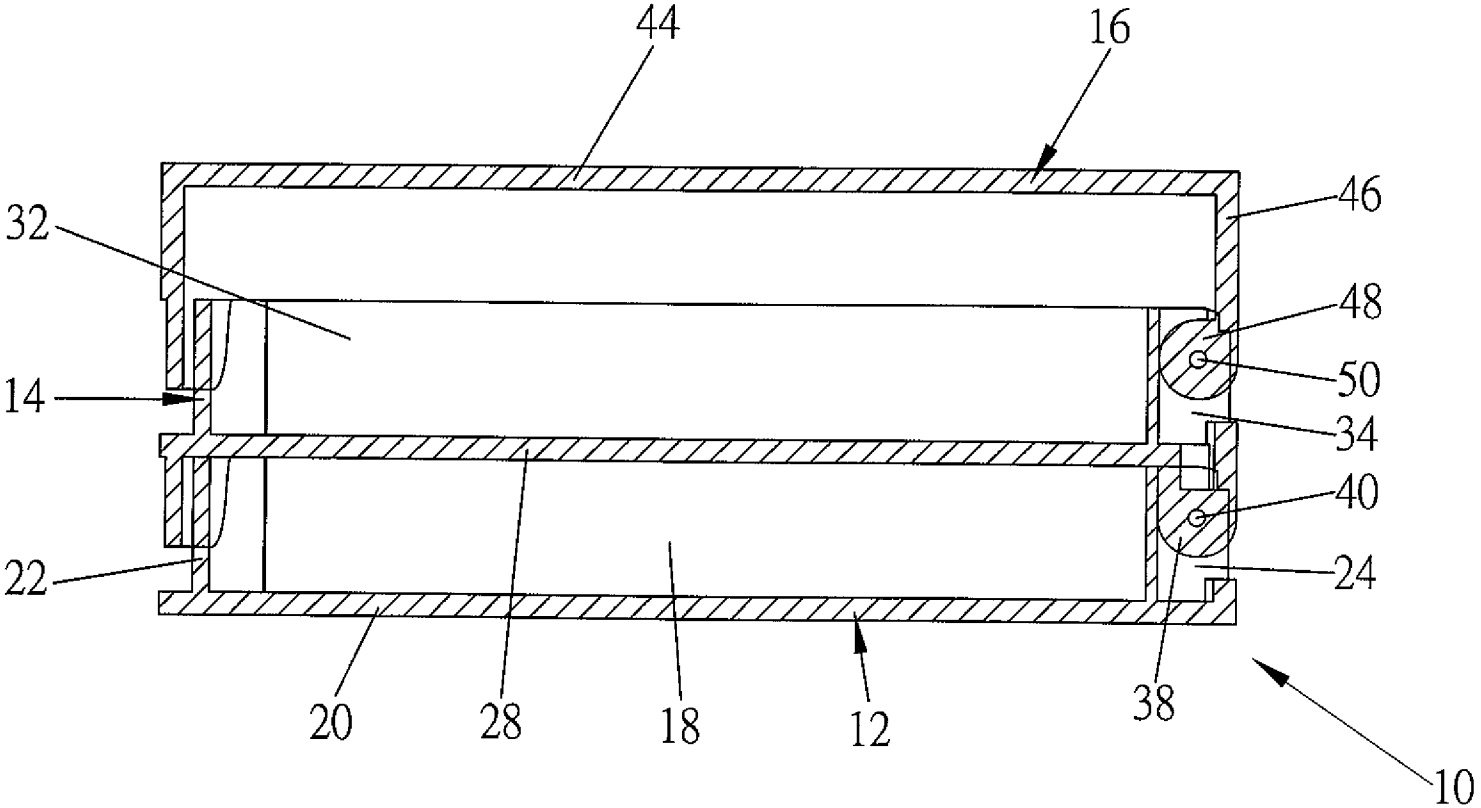
FIG. 4 is a sectional view of the clamshell case of FIG. 1.

A clamshell case 10 according to a first embodiment of the present invention is shown in FIGS. 1 through 4 of the drawings and includes a case bottom 12, an intermediate layer (intermediate case body) 14 and a lid 16. The case bottom 12 in which a chamber 18 is defined includes a bottom plate 20 and a wall plate 22 extending upward from an edge of the bottom plate 20. A pivot slot 24 is formed in an upper back of the wall plate 22, and two opposite pivot holes 26 are provided in the wall plate 22 and located at two sides of the pivot slot 24.

The intermediate layer 14 includes a seat board 28 and an enclosure 30 extending upward from an edge of the seat board 28 and defining a chamber 32 inside the intermediate layer 14. A coupling slot 34 is formed in an upper back of the enclosure 30, and two opposite pivot holes 36 are provided in the enclosure 30 and located at two sides of the coupling slot 34. At a lower back of the enclosure 30 is designed a pivot block 38 in which a transverse pinhole 40 is opened. The pivot block 38 of the intermediate layer 14 is held in the pivot slot 24 of the case bottom 12, and the pinhole 40 in the pivot block 38 is aligned with the pivot holes 26 of the case bottom 12. The intermediate layer 14 is pivotally fitted over the case bottom 12 with two pivots 42 respectively penetrating the pivot holes 26 of the case bottom 12 into the pinhole 40 of the intermediate layer 14. In this embodiment, the intermediate layer 14 which is identical to the case bottom 12 in shape and size is stacked on the case bottom 12 for open-close operations relative to the case bottom 12. In another feasible embodiment, the intermediate layer 14 is pivotally fitted over the case bottom 12 with a single pivot 42 penetrating the pivot holes 26 of the case bottom 12 as well as the pinhole 40 of the intermediate layer 14.

The lid 16 includes a cover plate 44 and a wall plate 46 extending downward from an edge of the cover plate 44. The wall plate 46 is provided with a pivot block 48 protruding from a lower back thereof, and a transverse pinhole 50 is opened in the pivot block 48. The pivot block 48 is held in the coupling slot 34 of the intermediate layer 14, and the pinhole 50 in the pivot block 48 is aligned with the pivot holes 36 of the intermediate layer 14. The lid 16 is pivotally fitted over the intermediate layer 14 with two pivots 52 penetrating the pivot holes 36 of the intermediate layer 14 into the pinhole 50 of the lid 16. In this embodiment, the lid 16, which is identical to the intermediate layer 14 in shape and size, is stacked on the intermediate layer 14 for open-close operations relative to the intermediate layer 14. In another feasible embodiment, the lid 16 is internally provided with a mirror (not shown in the figures).

Figure 5:
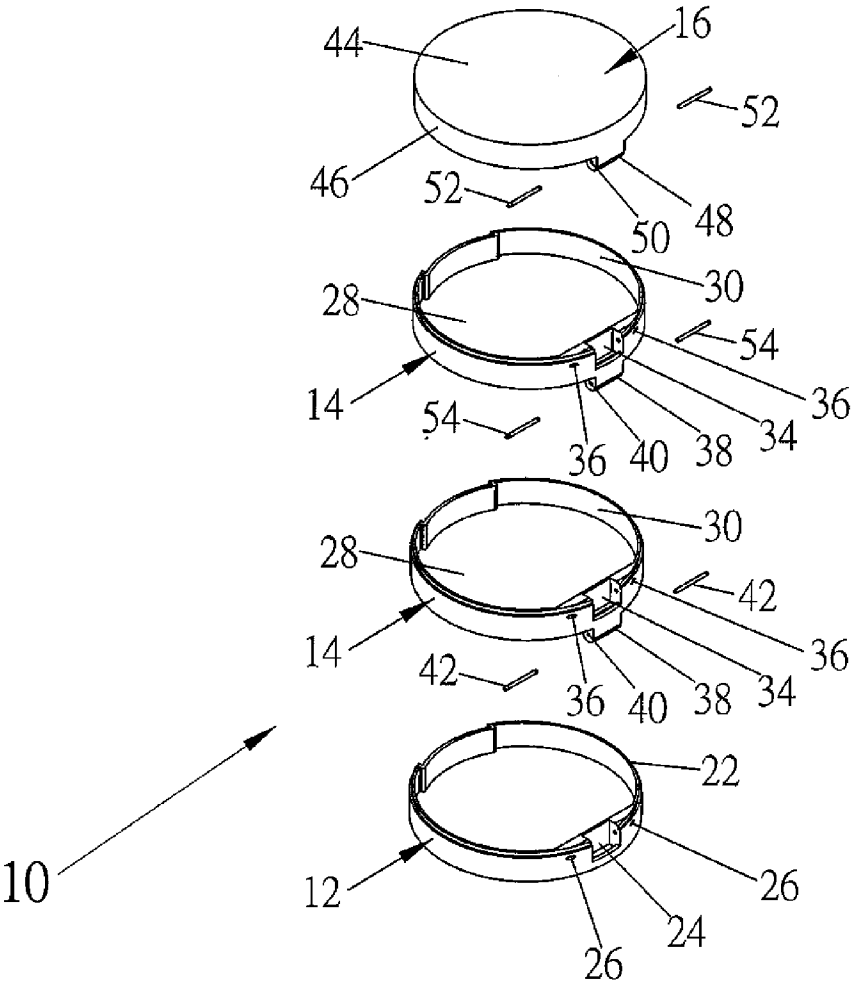
FIG. 5 is another exploded, perspective view of the clamshell case according to the first embodiment of the present invention which includes two intermediate layers.
Figure 6:
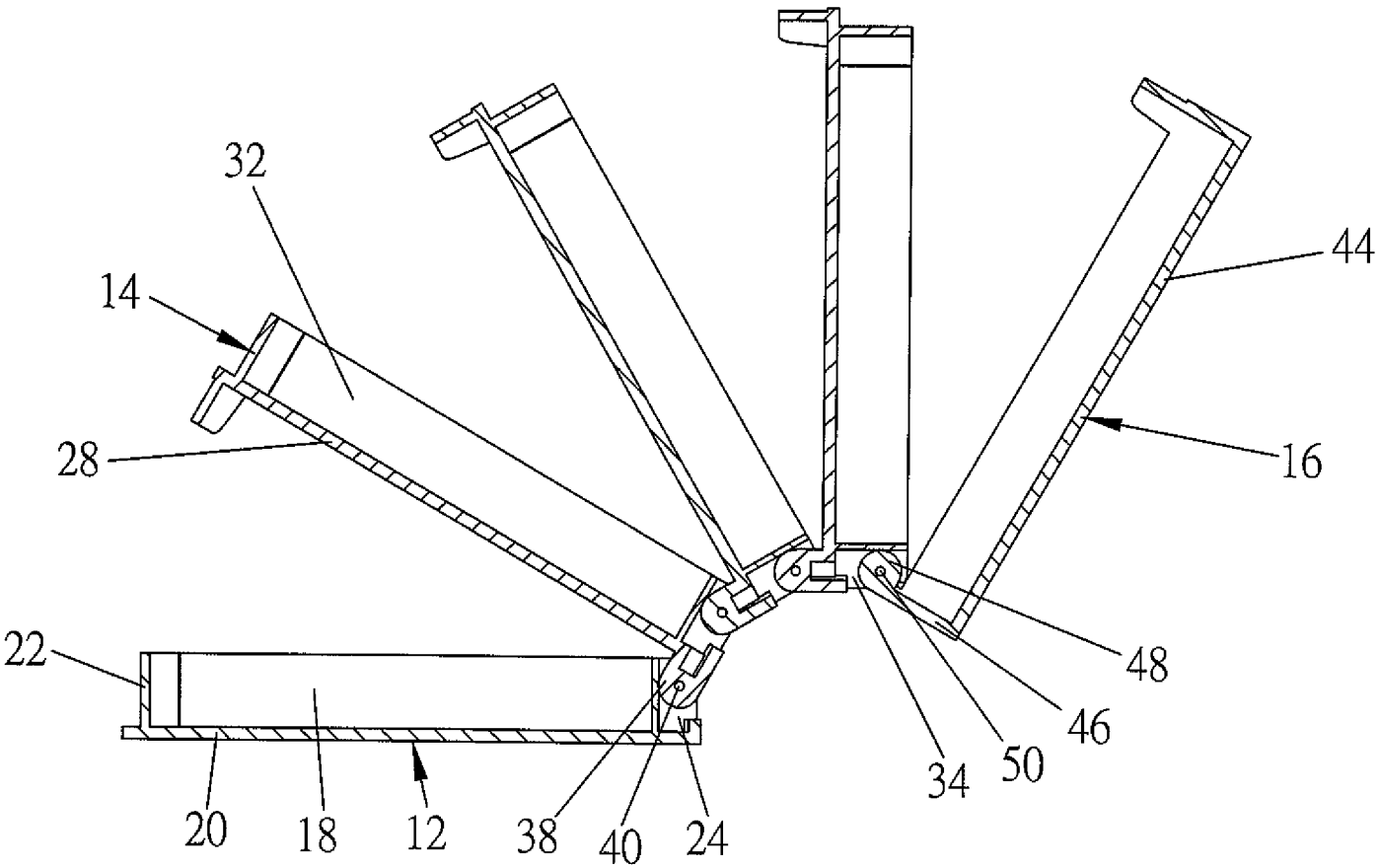
FIG. 6 is a schematic sectional view of the clamshell case according to the first embodiment of the present invention which includes three intermediate layers.

In the embodiments from FIG. 1 to FIG. 4, the clamshell case 10 includes a single intermediate layer 14 which is pivotally engaged with the case bottom 12 and the lid 16 for assembling a triple-decker clamshell case 10. As a makeup case, the clamshell case 10 allows cosmetics, such as pressed powder and eye shadow, to be held in the chamber 18 of the case bottom 12 and the chamber 32 of the intermediate layer 14, respectively. In another feasible embodiment, the clamshell case 10 includes several modular intermediate layers 14. The clamshell case 10 may include two intermediate layers 14 as shown in FIG. 5 or three intermediate layers 14 as shown in FIG. 6. The intermediate layers 14, which are structurally identical to one another, can be manufactured in modular production for lowering mold costs. In the embodiment of FIG. 5, the clamshell case 10 includes a first intermediate layer 14 over the case bottom 12 and a second intermediate layer 14 over the first intermediate layer 14. The first and second intermediate layers 14, which are stacked on and pivotally fitted at each other, constitutes a quadruple-decker clamshell case 10 with the pivot block 38 of the second intermediate layer 14 held in the coupling slot 34 of the first intermediate layer 14 and with two pivots 54 penetrating the pivot holes 36 of the first intermediate layer 14 into the pinhole 40 of the second intermediate layer 14. In the embodiment of FIG. 6, three intermediate layers 14, which are stacked on and pivotally fitted at each other, constitutes a quintuple-decker clamshell case 10.

In the clamshell case 10 of the present invention, the pivot blocks 38 of all intermediate layers 14 are of equal height and identical axial position. Therefore, the pivot block 38 of each intermediate layer 14 can be held in the pivot slot 24 of the case bottom 12 and pivotally fitted at the case bottom 12. Furthermore, two intermediate layers 14 can be pivotally fitted at each other with the pivot block 38 of one intermediate layer 14 stacked in the coupling slot 34 of the other intermediate layer 14. As such, the clamshell case 10, which includes an unlimited number of intermediate layers 14 as required by a manufacturer or a consumer, is very convenient in use. Further, the modular intermediate layers 14 are produced in one mold for lower manufacture costs.

Figure 7:
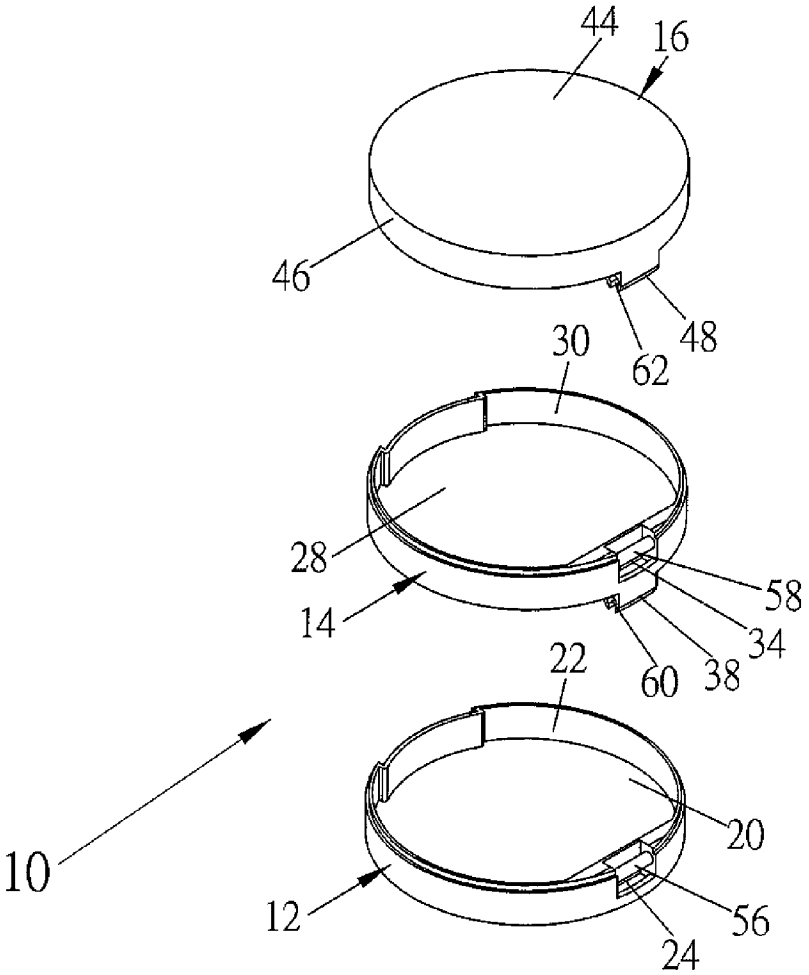
FIG. 7 is an exploded, perspective view of a clamshell case according to a second embodiment of the present invention.
Figure 8:
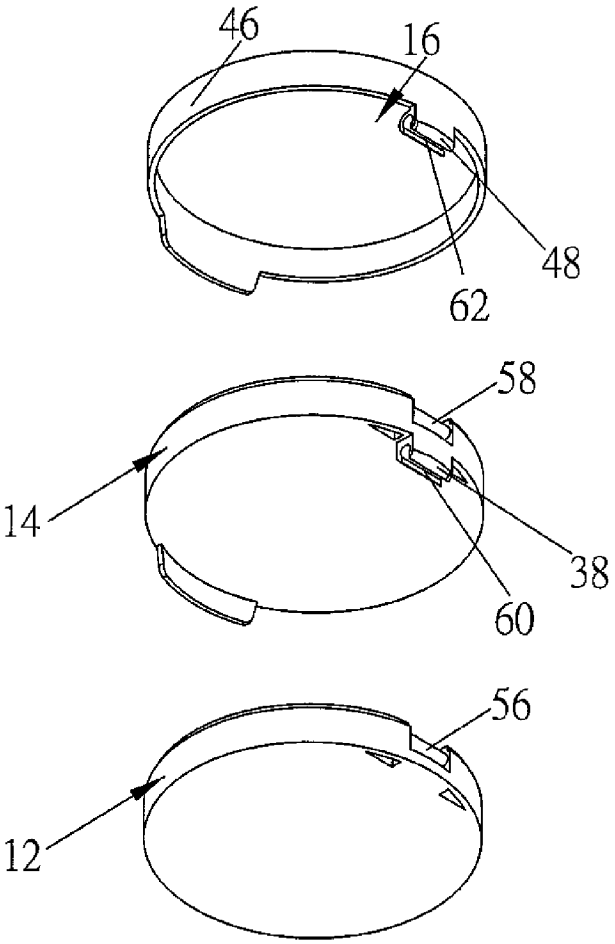
FIG. 8 is another exploded, perspective view of the clamshell case according to the second embodiment of the present invention.
Figure 9:
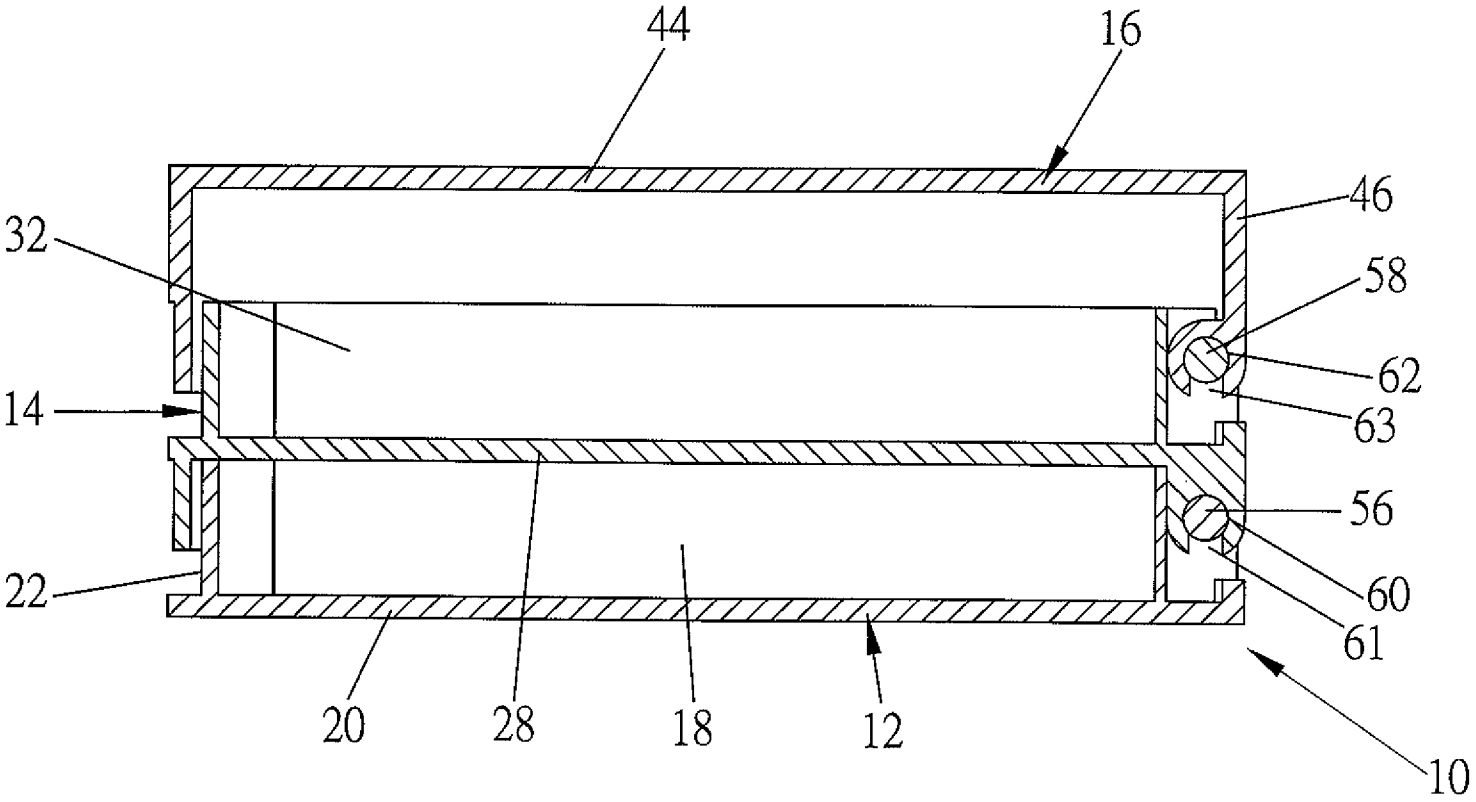
FIG. 9 is a sectional view of the clamshell case of FIG. 7.
Figure 10:
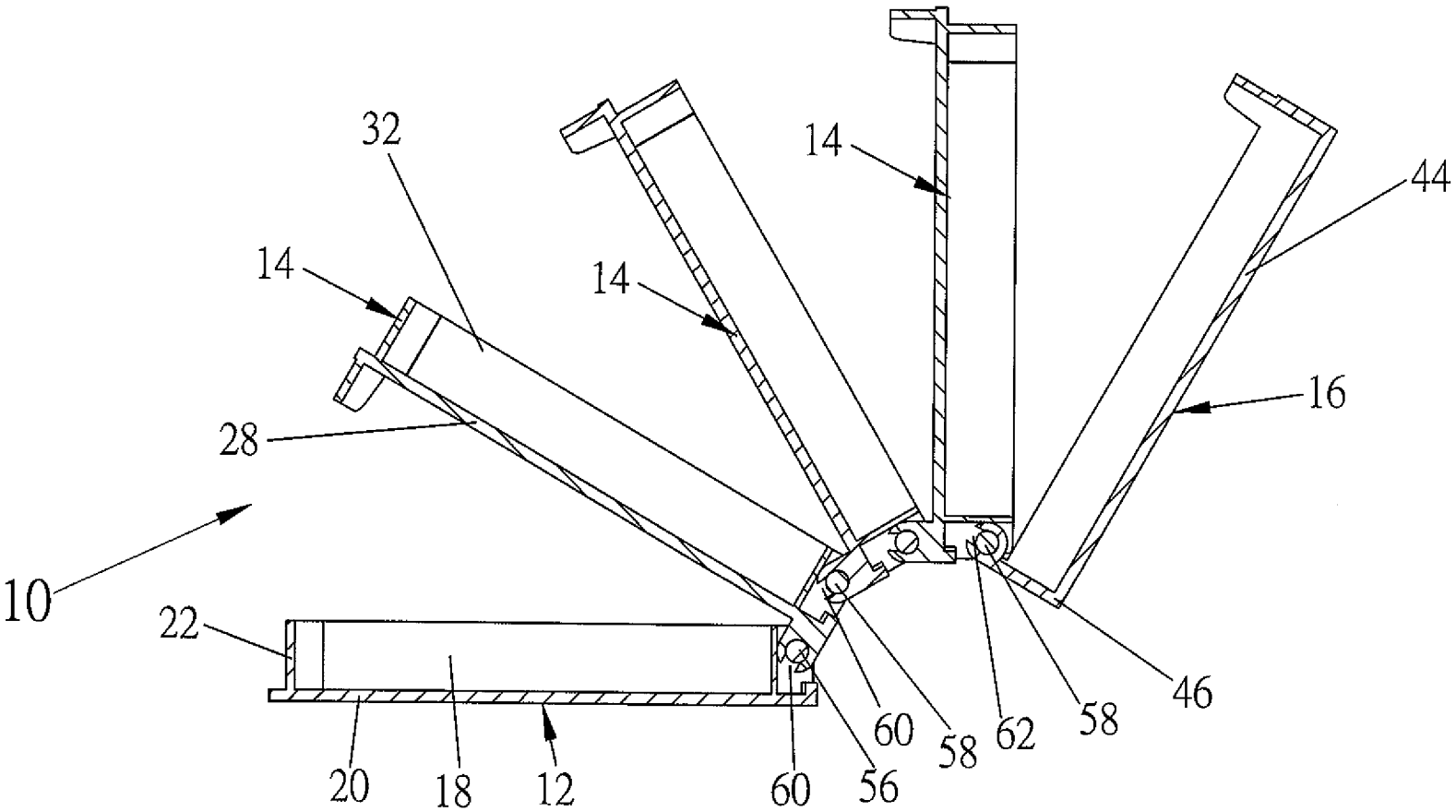
FIG. 10 is a schematic sectional view of the clamshell case according to the second embodiment of the present invention which includes three intermediate layers.
Figure 11A:
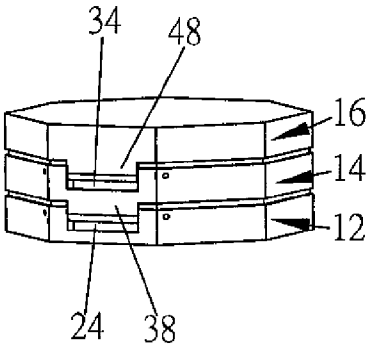
FIGS. 11A, 11B, 11C and 11D are schematic perspective views which illustrate octagonal clamshell cases in four embodiments of the present invention.
Figure 11B:
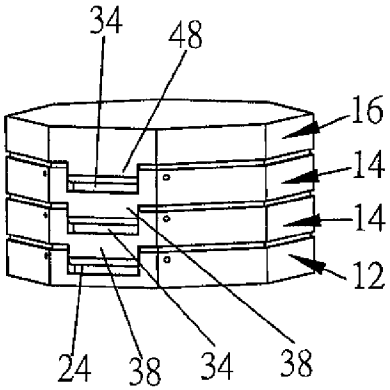
Figure 11C:
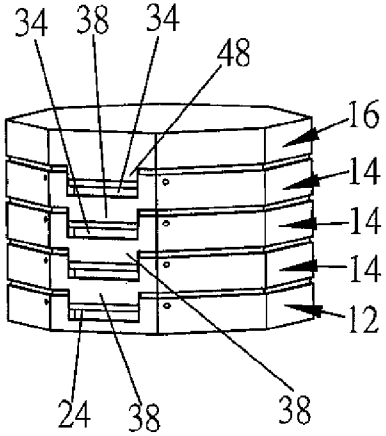
Figure 11D:
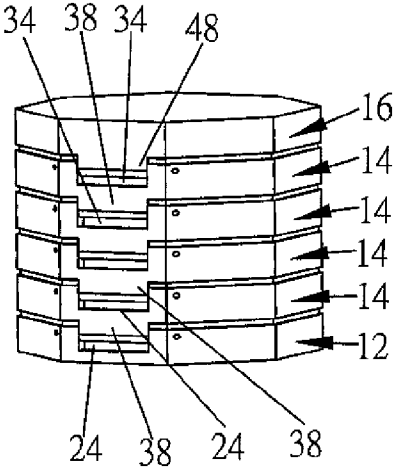
Figure 12A:
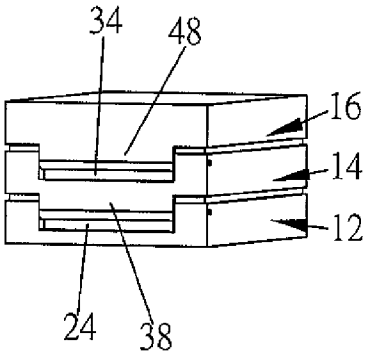
FIGS. 12A, 12B, 12C and 12D are schematic perspective views which illustrate rectangular clamshell cases in four embodiments of the present invention.
Figure 12B:
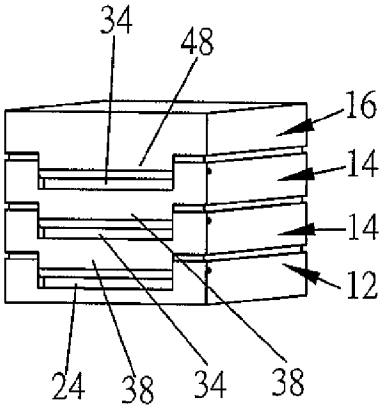
Figure 12C:
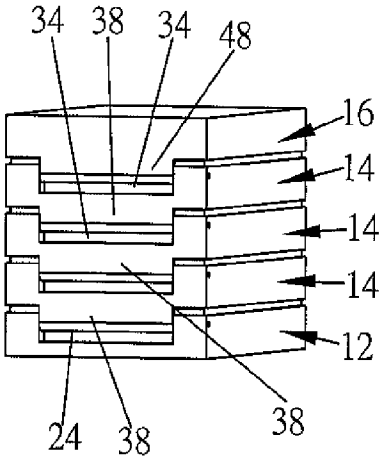
Figure 12D:
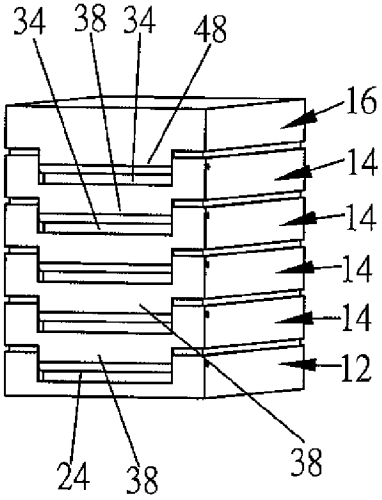

A clamshell case 10 according to a further embodiment of the present invention is shown in FIGS. 7 through 9 and includes a case bottom 12, an intermediate layer 14, and a lid 16. In this embodiment, pivot portions 56 and 58 which substitute the pivots 42 and 52 in FIG. 1 are respectively designed in the pivot slot 24 of the case bottom 12 and the coupling slot 34 of the intermediate layer 14, and no pivot holes 26, 36 in FIG. 1 are opened in the wall plate 22 of the case bottom 12 and the enclosure 30 of the intermediate layer 14. Moreover, a transverse through-hole 60 with a lower opening 61 and a transverse through-hole 62 with a lower opening 63, which substitute the pinholes 40 and 50 in FIG. 1, are respectively designed in a lower end of the pivot block 38 of the intermediate layer 14 and a lower end of the pivot block 48 of the lid 16. As such, the intermediate layer 14 is openably engaged on the case bottom 12 with the pivot block 38 of the intermediate layer 14 held in the pivot slot 24 of the case bottom 12 and with the through-hole 60 of the intermediate layer 14 pivotally fitted at the pivot portion 56 of the case bottom 12. In addition, a triple-decker clamshell case 10 is assembled when the pivot block 48 of the lid 16 is held in the coupling slot 34 of the intermediate layer 14, and the through-hole 62 of the pivot block 48 is pivotally fitted at the pivot portion 58 of the intermediate layer 14. Similarly, the clamshell case 10 in this embodiment may include several modular intermediate layers 14. Therefore, a user who needs one more intermediate layer 14 may engage the pivot portion 58 of one intermediate layer 14 in the through-hole 60 of the other intermediate layer 14, so that the intermediate layers 14 are stacked on and pivotally fitted at each other (see FIG. 10). The clamshell case 10 of this embodiment includes a plurality of modular intermediate layers 14 which are produced in one mold for lower manufacture costs. Moreover, the clamshell case 10, which consists of the lid 16 and the intermediate layers 14 easily assembled or disassembled, features multiple intermediate layers 14 replaced conveniently.

In the previous embodiments, the case bottom 12, the intermediate layers 14 and the lid 16 of the clamshell case 10 are circular components. In other feasible embodiments, the case bottom 12, the intermediate layers 14 and the lid 16 may be octagonal components (as shown in FIGS. 11A, 11B, 11C and 11D), rectangular components (as shown in FIGS. 12A, 12B, 12C and 12D) or other geometric-shaped components. Furthermore, multiple intermediate layers 14 can be freely stacked for development of a triple-decker, quadruple-decker, quintuple-decker or sextuple-decker clamshell case 10, as shown in FIG. 11A through FIG. 11D and FIG. 12A through FIG. 12D.

The scope of the invention is to be indicated by the appended claims, rather than by the foregoing description, and all changes which come within the meaning and range of equivalency of the claims are intended to be embraced therein.

The invention claimed is:

1. A clamshell case comprising:

a case bottom including a bottom plate and a wall plate extending upward from an edge of the bottom plate, with a pivot slot having a shape and size and formed in an upper back of the wall plate, with two opposite pivot holes provided in the wall plate and located at two sides of the pivot slot;

at least one intermediate layer pivotally fitted over the case bottom, with the at least one intermediate layer including a seat board and an enclosure extending upward from an edge of the seat board, with a coupling slot having a shape and size and formed in an upper back of the enclosure, with two opposite pivot holes provided in the enclosure and located at two sides of the coupling slot, with the shape and size of the pivot slot being identical to the shape and size of the coupling slot, with a layer pivot block having a shape and size and protruding from a lower back of the enclosure and including a transverse pinhole therein, with the shape and size of the layer pivot block corresponding to and slideably and pivotally received in the pivot slot, with the layer pivot block of the at least one intermediate layer held in the pivot slot of the case bottom, with two bottom pivots respectively penetrating the pivot holes of the case bottom into the transverse pinhole of the at least one intermediate layer; and a lid pivotally fitted over the at least one intermediate layer and including a cover plate and a wall plate extending downward from an edge of the cover plate, with a lid pivot block having a shape and size and protruding from a lower back of the wall plate of the lid and including a transverse pinhole therein, with the shape and size of the lid pivot block being identical to the shape and size of the layer pivot block, with the shape and size of the lid pivot block corresponding to and slideably and pivotally received in the coupling slot, with the lid pivot block of the lid held in the coupling slot of the at least one intermediate layer, with two lid pivots respectively penetrating the pivot holes of the at least one intermediate layer into the transverse pinhole of the lid.

2. The clamshell case according to claim 1, wherein the at least one intermediate layer includes a plurality of intermediate layers, with the layer pivot block of one of the plurality of intermediate layers held in the coupling slot of another one of the plurality of intermediate layers, wherein the one of the plurality of intermediate layers is stacked on and pivotally fitted at the other one of the plurality of intermediate layers with two layer pivots respectively penetrating the pivot holes of the other one of the plurality of intermediate layers into the transverse pinhole of the one of the plurality of intermediate layers.

3. The clamshell case according to claim 2, wherein the layer pivot blocks of the plurality of intermediate layers are of equal height and identical axial position.

4. The clamshell case according to claim 1, wherein the transverse pinhole of the at least one intermediate layer is aligned with the two opposite pivot holes of the case bottom.

5. A clamshell case comprising:

a case bottom including a bottom plate and a wall plate extending upward from an edge of the bottom plate, with a pivot slot having a shape and size and formed in an upper back of the wall plate, with a pivot portion provided in the pivot slot of the case bottom;

at least one intermediate layer pivotally fitted over the case bottom, with the at least one intermediate layer including a seat board and an enclosure extending upward from an edge of the seat board, with a coupling slot having a shape and size and formed in an upper back of the enclosure, with a pivot portion provided in the coupling slot, with a layer pivot block protruding from a lower back of the enclosure and including a transverse through-hole therein, with the shape and size of the pivot slot being identical to the shape and size of the coupling slot, with the layer pivot block of the at least one intermediate layer held in the pivot slot of the case bottom, with the transverse through-hole of the at least one intermediate layer pivotally fitted at the pivot portion of the case bottom; and a lid pivotally fitted over the at least one intermediate layer and including a cover plate and a wall plate extending downward from an edge of the cover plate, with a lid pivot block having a shape and size and protruding from a lower back of the wall plate of the lid and including a transverse through-hole therein, with the shape and size of the lid pivot block being identical to the shape and size of the layer pivot block, with the shape and size of the lid pivot block corresponding to and slideably and pivotally received in the coupling slot, with the lid pivot block of the lid held in the coupling slot of the at least one intermediate layer, with the transverse through-hole of the lid pivotally fitted at the pivot portion of the at least one intermediate layer.

6. The clamshell case according to claim 5, wherein the at least one intermediate layer includes a plurality of intermediate layers, with the layer pivot block of one of the plurality of intermediate layers held in the coupling slot of another one of the plurality of intermediate layers, wherein the one of the plurality of intermediate layers is stacked on and pivotally fitted at the other one of the plurality of intermediate layers with the pivot portion of the other one of the plurality of intermediate layers engaged in the transverse through-hole of the one of the plurality of intermediate layers.

7. The clamshell case according to claim 6, wherein the layer pivot blocks of the plurality of intermediate layers are of equal height and identical axial position.

* * * * *